US007393022B1

(12) United States Patent
Shan et al.

(10) Patent No.: US 7,393,022 B1
(45) Date of Patent: Jul. 1, 2008

(54) BACKSET ADJUSTABLE DEADBOLT

(75) Inventors: Chen Fu Shan, Taipei (TW); Chia Hung Lin, Taipei (TW)

(73) Assignee: Shin An Enterprise Inc., Fish Meadows, NY (US)

( * ) Notice: Subject to any disclaimer, the term of this patent is extended or adjusted under 35 U.S.C. 154(b) by 0 days.

(21) Appl. No.: 11/655,609

(22) Filed: Jan. 19, 2007

(51) Int. Cl.
*E05C 1/00* (2006.01)
*E05B 9/00* (2006.01)

(52) U.S. Cl. ..... 292/1.5; 292/337; 292/DIG. 60

(58) Field of Classification Search ..... 292/1.5, 292/337, 137, 163, 169, DIG. 60, DIG. 54, 292/155, DIG. 64, 350; 70/461
See application file for complete search history.

(56) References Cited

U.S. PATENT DOCUMENTS 4,656,849 A * 4/1987 Rotondi et al. ..... 70/134
4,772,055 A * 9/1988 Fang ..... 292/1.5
4,895,404 A * 1/1990 Toledano ..... 292/337
5,364,138 A * 11/1994 Dietrich et al. ..... 292/1.5
5,456,503 A 10/1995 Russell, IV
6,401,297 B1 * 6/2002 Huang ..... 292/1.5
6,443,503 B1 * 9/2002 Fan Lu et al. ..... 292/1.5
6,688,660 B2 * 2/2004 Huang ..... 292/337
6,837,526 B2 1/2005 Markbreit
6,949,290 B2 * 9/2005 Schaeffeler et al. ..... 428/411.1

* cited by examiner

*Primary Examiner*—Patricia Engle
*Assistant Examiner*—Alyson M Merlino
(74) *Attorney, Agent, or Firm*—James A. Quinton

(57) ABSTRACT

A backset adjustable deadbolt for mounting in a lock cylinder is provided. A deadbolt assembly includes an actuator connected to and movable by the movement of the lock cylinder through the lock cylinder connector. A link bar connects the actuator to the deadbolt at a plurality of attachment points. The deadbolt, lock cylinder connector, actuator, link bar form the deadbolt assembly and are mounted in a housing. A releasable connector extends through the housing. In the engaged position, a releasable connector contacts the actuator to lock the actuator remote end in one of the plurality of attachment points in the link bar. In the disengaged position, the releasable connector releases the actuator remote end from the link bar to allow the link bar move relative to the actuator from one of the plurality of attachment points to a different point for reengagement with the actuator remote end.

14 Claims, 8 Drawing Sheets

BACKSET ADJUSTABLE DEADBOLT

FIELD OF THE INVENTION

The present invention relates to deadbolt assemblies and particularly to an extendable deadbolt, which can extend from one standard size to another.

BACKGROUND OF THE INVENTION

Different types of deadbolts are commercially available. Deadbolts are thrown and retracted by a key-operated cylinder which passes through a hub of the deadbolt assembly. Turning the key turns the hub, which causes an actuator to throw or retract the bolt. Some deadbolts are operated by a single cylinder, wherein the deadbolt is actuated by a key from outside the door and by a turn piece from inside the door. Other deadbolts are operated by a double cylinder, wherein the deadbolt is thrown or retracted by a key from both sides of the door.

Deadbolts are thrown and retracted into a doorpost through a metal plate called a strike. The distance between the strike and the center of the hub is called the backset. In the United States, standard backsets are generally 60 mm or 70 mm. The throw of the deadbolt varies from one lock to another, with the maximum generally being 1 inch.

Deadbolts with an adjustable backset are known. See U.S. Pat. No. 6,837,526 (Markbreit). However, such deadbolts have to be disassembled to change the backset.

SUMMARY OF THE INVENTION

According to the invention, a backset adjustable deadbolt for mounting in a lock cylinder is provided as well as a method of adjusting the backset of a deadbolt. The device includes a deadbolt assembly. The deadbolt assembly is composed of a deadbolt for engagement in a door post or door jam. A lock cylinder connector having a hub for mounting in a lock cylinder is provided which is typically actuated by a key. The deadbolt assembly also includes an actuator connected to and movable by the movement of the lock cylinder through the lock cylinder connector. The actuator has a proximate end and a remote end. A link bar connects the actuator to the deadbolt at a plurality of attachment points formed on the link bar. Desirably the attachment points are slots in the link bar. The deadbolt, lock cylinder connector, actuator, and link bar form the deadbolt assembly and are mounted in a housing. The deadbolt is slidingly disposed in the housing for engagement with a door latch keeper. A faceplate is attached to the housing. The distance between the outer surface of the faceplate and the center of the hub is defined as the backset.

A releasable connector which extends through the housing is provided. The releasable connector has an engaged position and a disengaged position. In the engaged position, the releasable connector contacts the actuator to lock the actuator remote end in one of the plurality of attachment points in the link bar. In the disengaged position, the releasable connector releases the actuator remote end from the link bar to allow the link bar to move relative to the actuator from one of the plurality of attachment points to a different attachment point for reengagement with the actuator remote end and change the backset. The backset is adjustable between a first backset and a second backset without removing the deadbolt assembly from said housing when the releasable connector is in the engaged position by moving the deadbolt assembly relative to said housing.

The backset is thus adjusted quickly and simply without removing the deadbolt, the lock cylinder connector, the actuator or the link bar from the housing.

In another aspect of the invention, a method for changing the backset of a deadbolt is provided. The releasable connector is disengaged from contacting the actuator. The link bar, the actuator remote end or both are moved so that said actuator remote end engages a different attachment point to adjust the backset. The backset is adjusted quickly and easily without removing the deadbolt, the lock cylinder connector, the actuator or the link bar from the housing.

The preferred embodiment of the present invention is illustrated in the drawings and examples. However, it should be expressly understood that the present invention should not be limited solely to the illustrative embodiment.

DETAILED DESCRIPTION OF THE INVENTION

Figure 1:
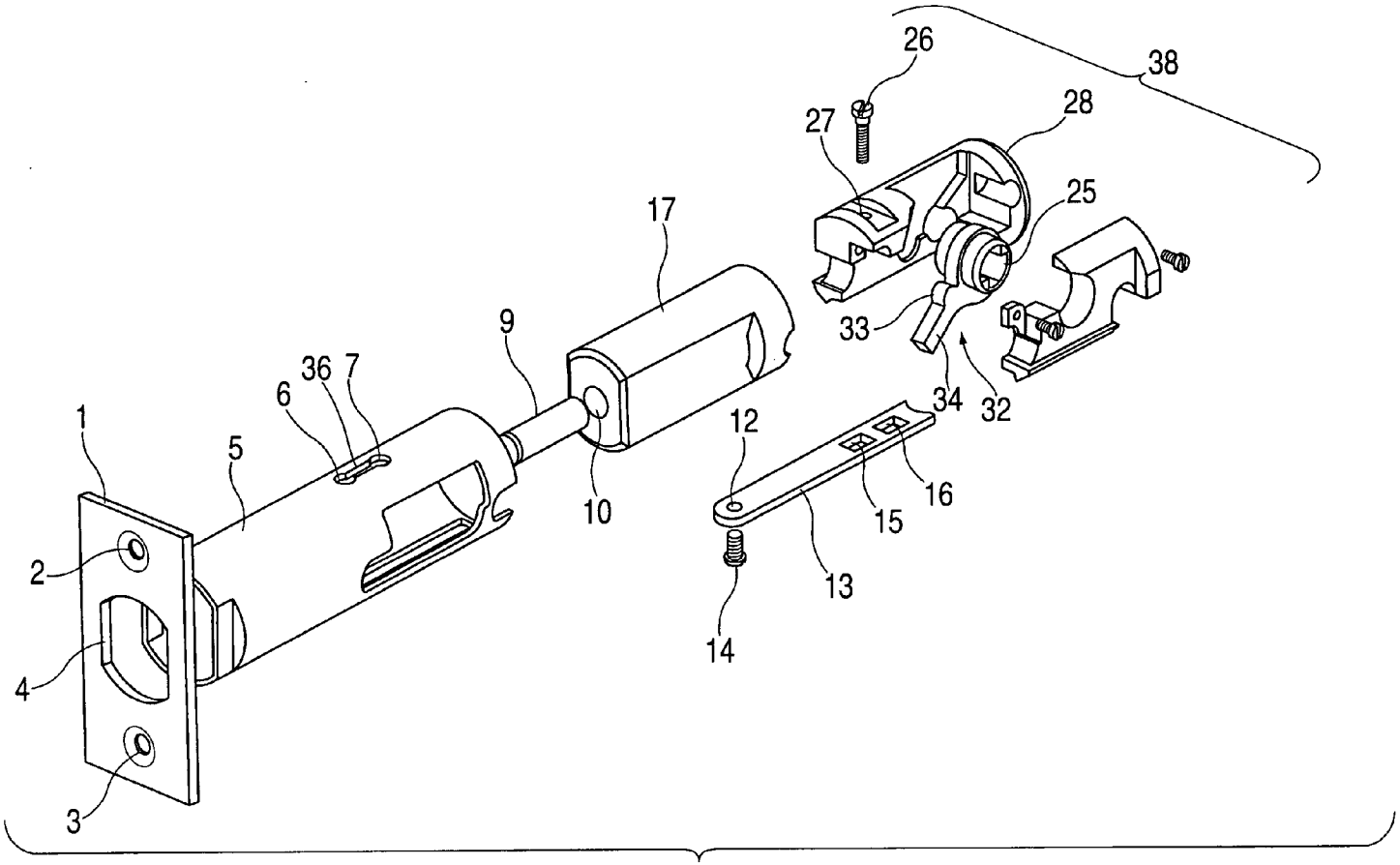
FIG. 1 is an exploded perspective view of the deadbolt according to the invention.
Figure 2:
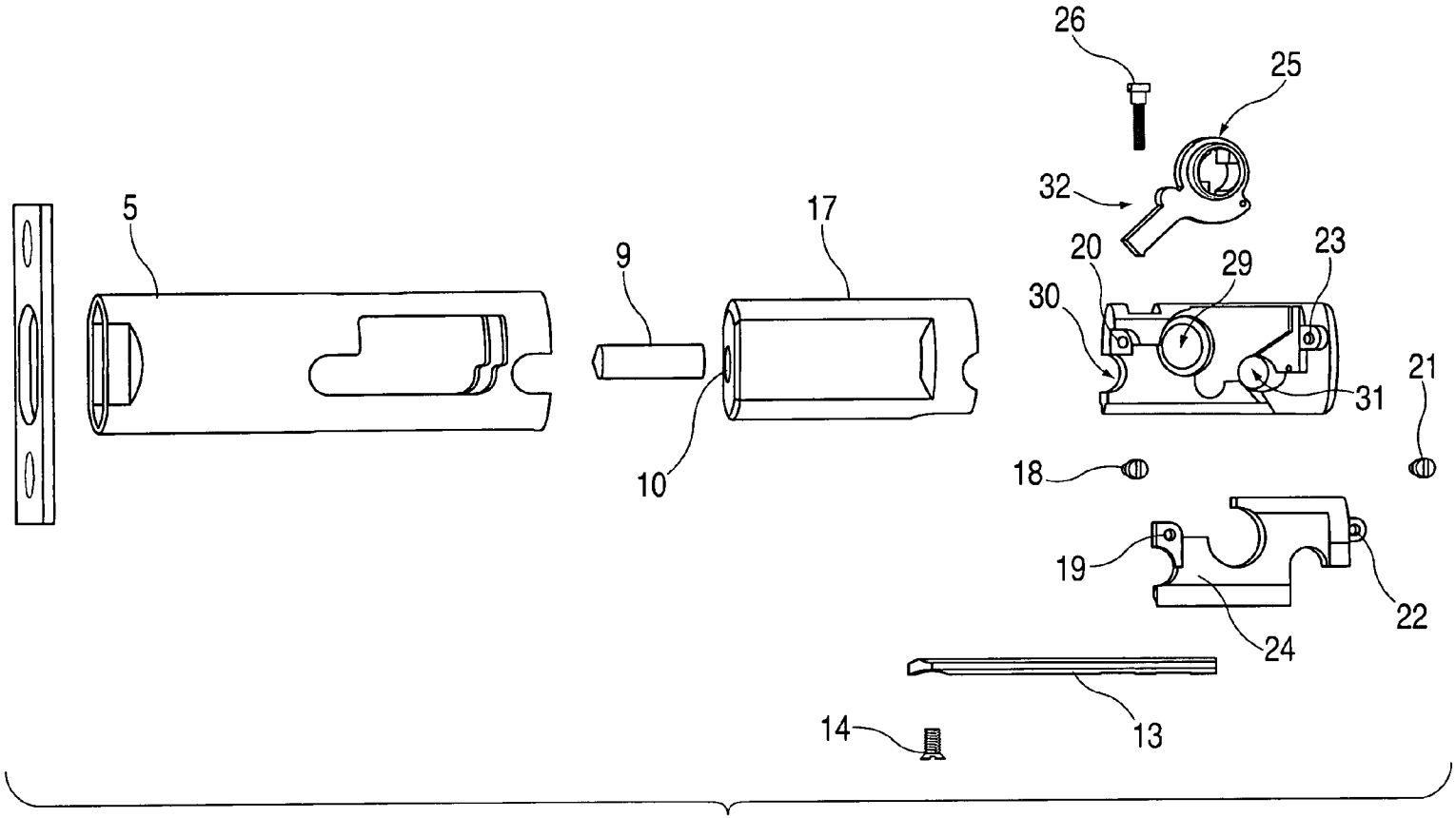
FIG. 2 is an exploded view of the deadbolt according to the invention looking from the side.

According to the invention, a backset adjustable deadbolt for mounting in a lock cylinder is provided as well as a method of adjusting the backset of a deadbolt. The distance between the strike and the center of the hub is called the backset. In the United States, standard backsets are generally 60 mm or 70 mm. It is important that a deadbolt is useable in the common backset configurations used in the building industry. Often the homeowner does not realize there are different backsets. It is desirable that the deadbolt backset can be varied easily does without disassembly of the deadbolt. According to the invention, the backset is adjusted quickly and simply without removing the deadbolt, the lock cylinder connector, the hub, the actuator or the link bar from said deadbolt assembly.

The device is composed of a deadbolt for engagement in a door post or door jam. A lock cylinder connector for mounting in a lock cylinder is provided which is typically actuated by a key. The lock cylinder connector includes a hub that is connected to the lock cylinder. The deadbolt also includes an actuator connected to and movable by the movement of the hub. The actuator is desirably arm shaped and connects the hub to a link bar which is in turn is connected to the deadbolt. The link bar connects the actuator to the deadbolt at a plurality of attachment points formed on the link bar. Desirably two attachment points are provided one for a backset of 60 mm and another for a backset of 70 mm. However the backsets are selected depending on the conventional backsets in the local of intended use. If desired more that two attachment points can be provided for example three or more attachment points and consequently three or more different backsets can be accommodated.

Desirably the attachment points are slots preferably two desirably three or more in the link bar. The actuator at the link bar end desirably has a protrusion preferably a boot like end for engagement in the slots in the link bar. The slots are preferably sized to receive the end of the actuator and to desirably provide a snug fit. The deadbolt, lock cylinder connector including the hub, actuator, link bar form the deadbolt assembly. The deadbolt assembly is mounted in a housing. The housing is preferably cylindrical having a cylindrical hollow core for receipt of the deadbolt assembly. The deadbolt is slidingly disposed in the housing for engagement with a door latch keeper upon the movement actuator through movement of the hub by the action of a key or turnpiece on the door. A faceplate is attached to the housing. The distance between the outer surface of the faceplate and the center of the hub is defined as the backset.

A releasable connector which extends through the housing is provided. The releasable connector has an engaged position and a disengaged position. Desirably the releasable connector is a screw which engages a screw receiving aperture preferably threaded in the lock cylinder connector. Optionally the screw receiving aperture can be provided in the housing. Preferably a first and a second aperture are provided in the housing for receipt of the screw. The first aperture receives the screw for a first backset desirably of 60 mm and the second aperture receives the screw for a second backset desirably of 70 mm. Desirably a channel connects the apertures to allow the screw below the screw head to be moved from aperture to aperture the disengaged position without removing the screw from the housing.

In the engaged position, the releasable connector contacts the actuator to lock the actuator remote end in one of the plurality of attachment points in the link bar. In the disengaged position, the releasable connector releases the actuator remote end from the link bar to allow the link bar to be moved relative to the actuator from one of the plurality of attachment points to a different attachment point for reengagement with the actuator remote end and a resulting change of the backset. As a result the backset is adjusted quickly and simply without removing the deadbolt, the lock cylinder connector, the hub, the actuator or the link bar from the housing.

Desirably the deadbolt according to the invention includes a reinforcing bar or rod of saw resistant material for example steel, hardened steel, tungsten or the like. A projection desirably extends from an end of the deadbolt to make a locator mark on a doorpost during installation so that a latch keeper can be positioned in the doorpost. Desirably the projection is provided by the front end of reinforcing bar or rod extending a short distance from the end of the deadbolt.

In another aspect of the invention, a method changing the backset of a deadbolt is provided. The releasable connector is disengaged from contacting the actuator. The link bar, the actuator remote end or both are moved so that the actuator remote end engages a different attachment point to adjust the backset. The backset is adjusted quickly and easily without removing the deadbolt, the lock cylinder connector, the hub, the actuator or the link bar from the housing. The connector is then engaged to lock the actuator remote end in the selected attachment point and provide the desired backset.

Referring to the FIGS. 1 to 9, an adjustable deadbolt assembly for mounting in a lock cylinder is provided. As best seen in seen in FIGS. 1 to 3, a hollow preferably generally cylindrical housing 5 is provided for receipt of the adjustable deadbolt assembly. Attached to one end of the housing 5 is a faceplate 1 which preferably has screw holes 2 and 3 for mounting to a door. An opening 4 is provided in the faceplate 1 to allow the extension and withdrawal of the deadbolt 17. Housing 5 has a hollow preferably cylindrical interior 8 for receipt of the deadbolt components. A lock cylinder connector 38 is provided which includes a provision for connection to a lock cylinder through holes 30 and 31.

Figure 3:
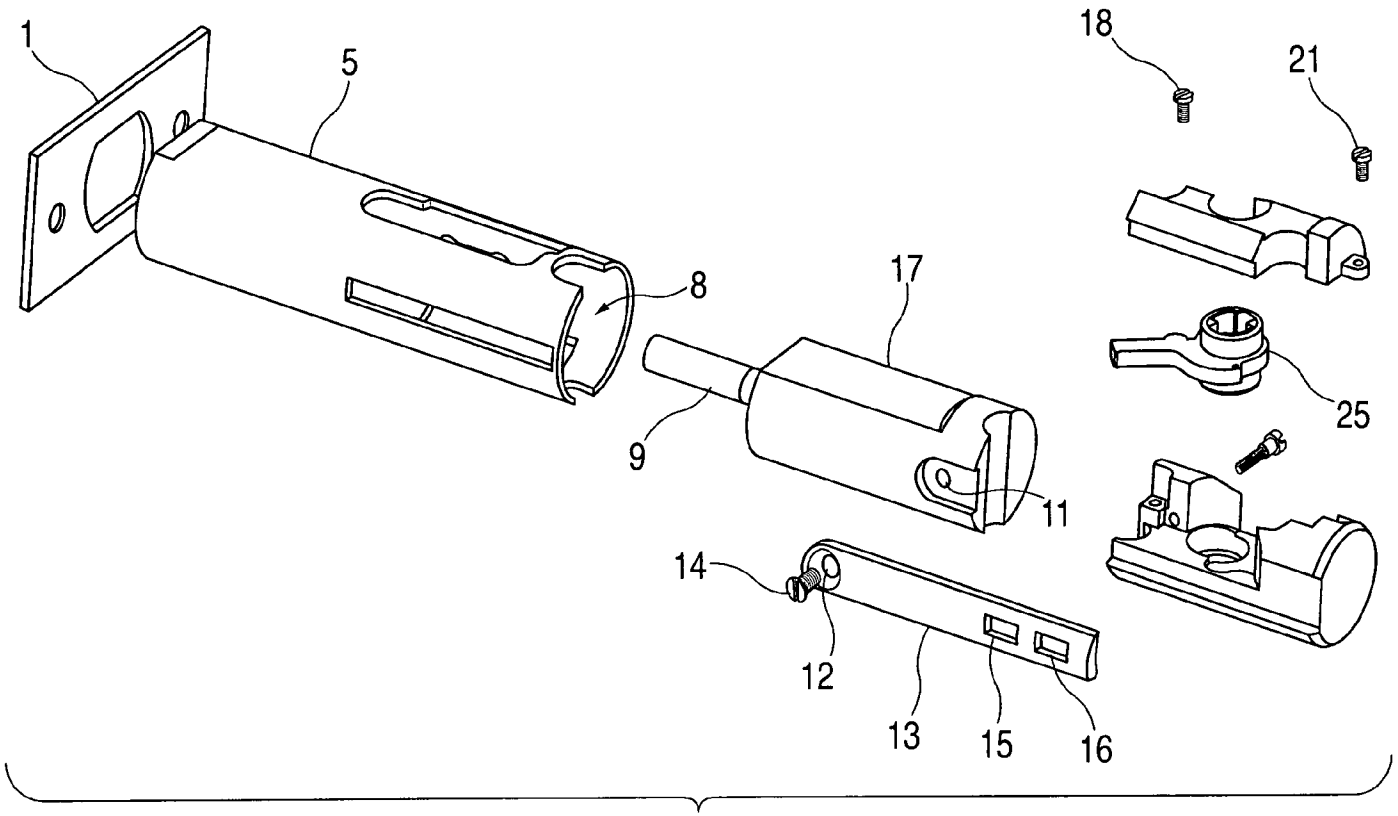
FIG. 3 is an exploded view of the deadbolt according to the invention looking from the bottom.
Figure 4:
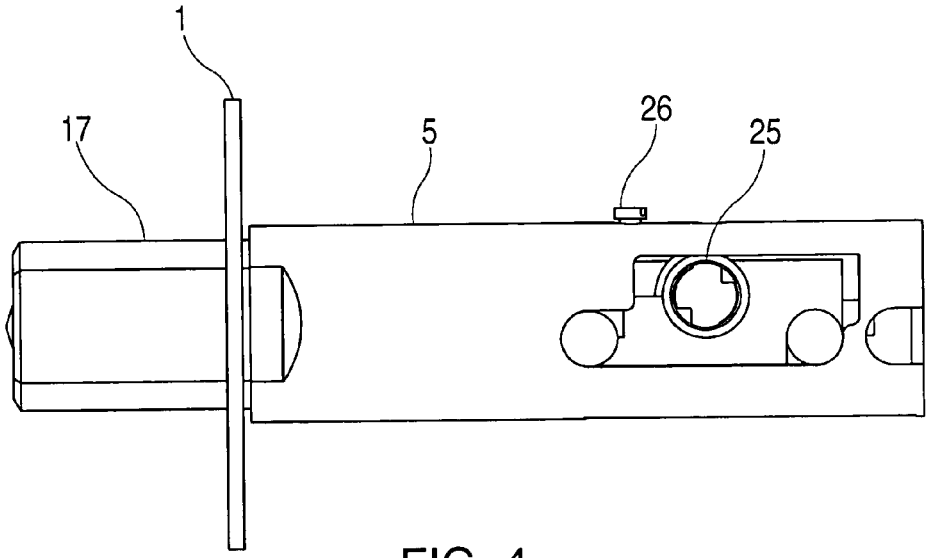
FIG. 4 is a side view of the assembled deadbolt according to the invention set for a backset of 60 mm.
Figure 5:
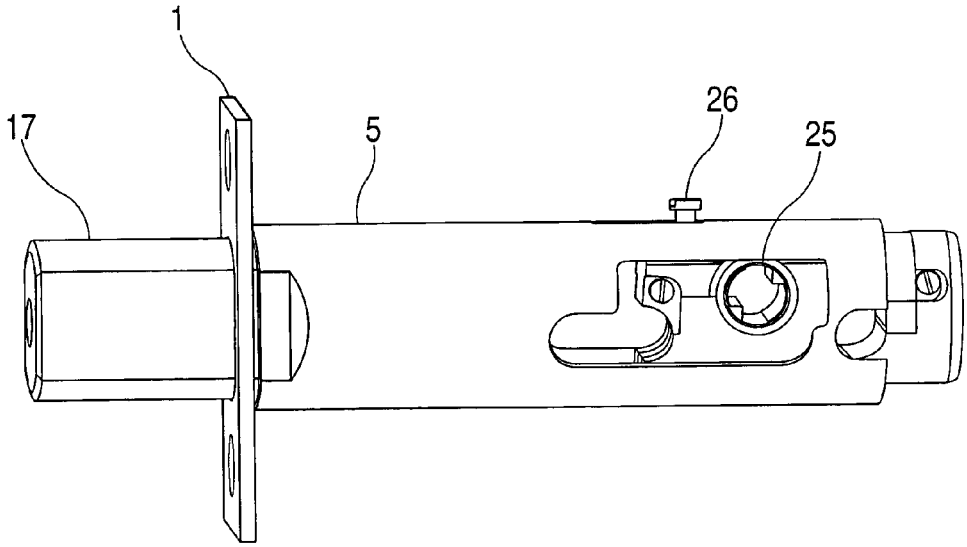
FIG. 5 is a side view of the assembled deadbolt according to the invention set for a backset of 70 mm
Figure 6:
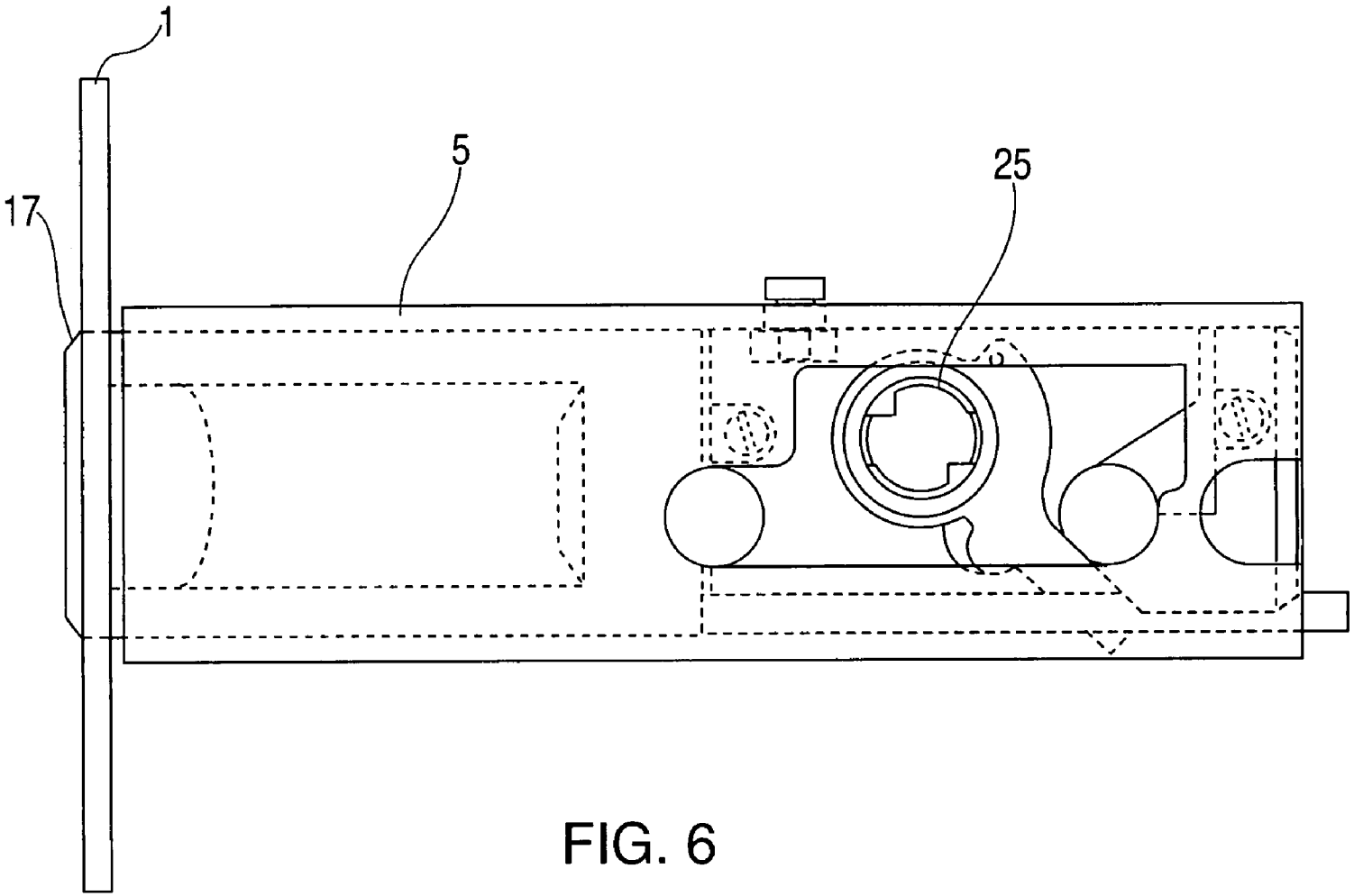
FIG. 6 is a side view of the assembled deadbolt according to the invention with the deadbolt withdrawn
Figure 7:
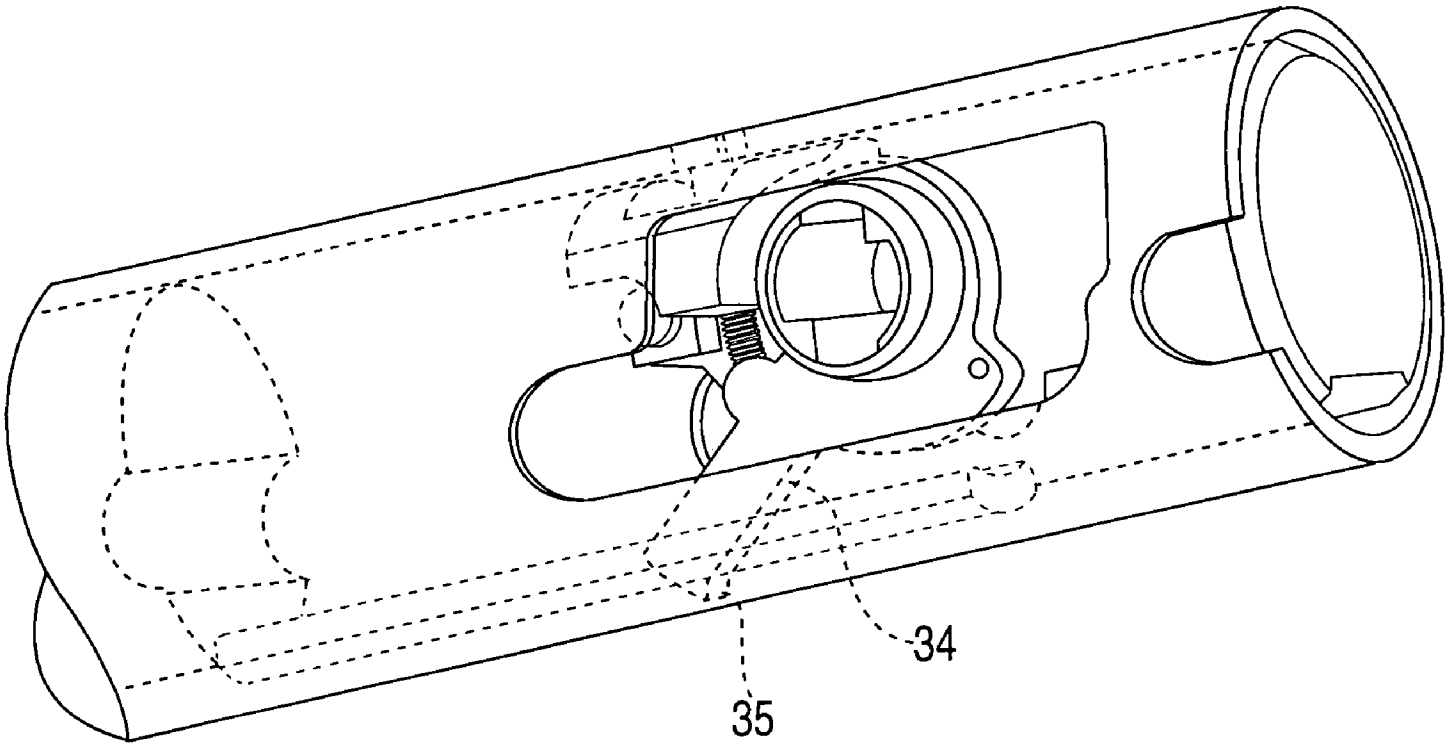
FIG. 7 is a side perspective view of the invention.
Figure 8:
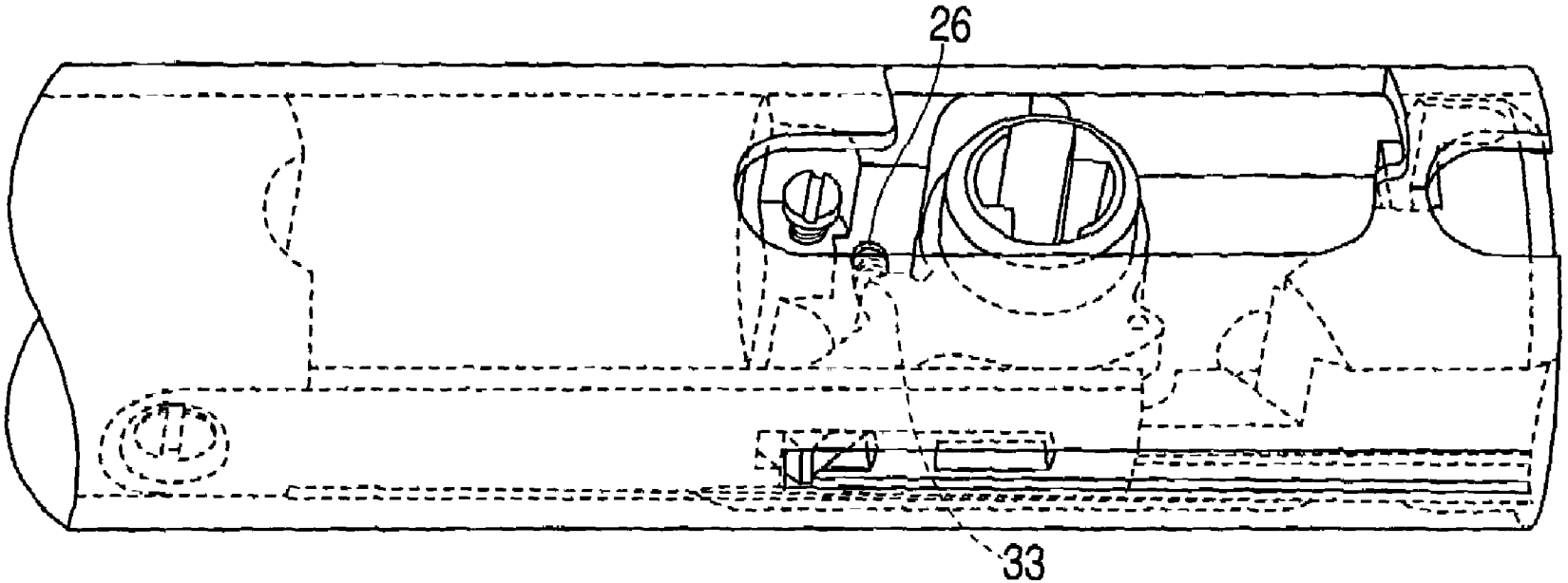
FIG. 8 is a side/bottom perspective view of the invention.
Figure 9:
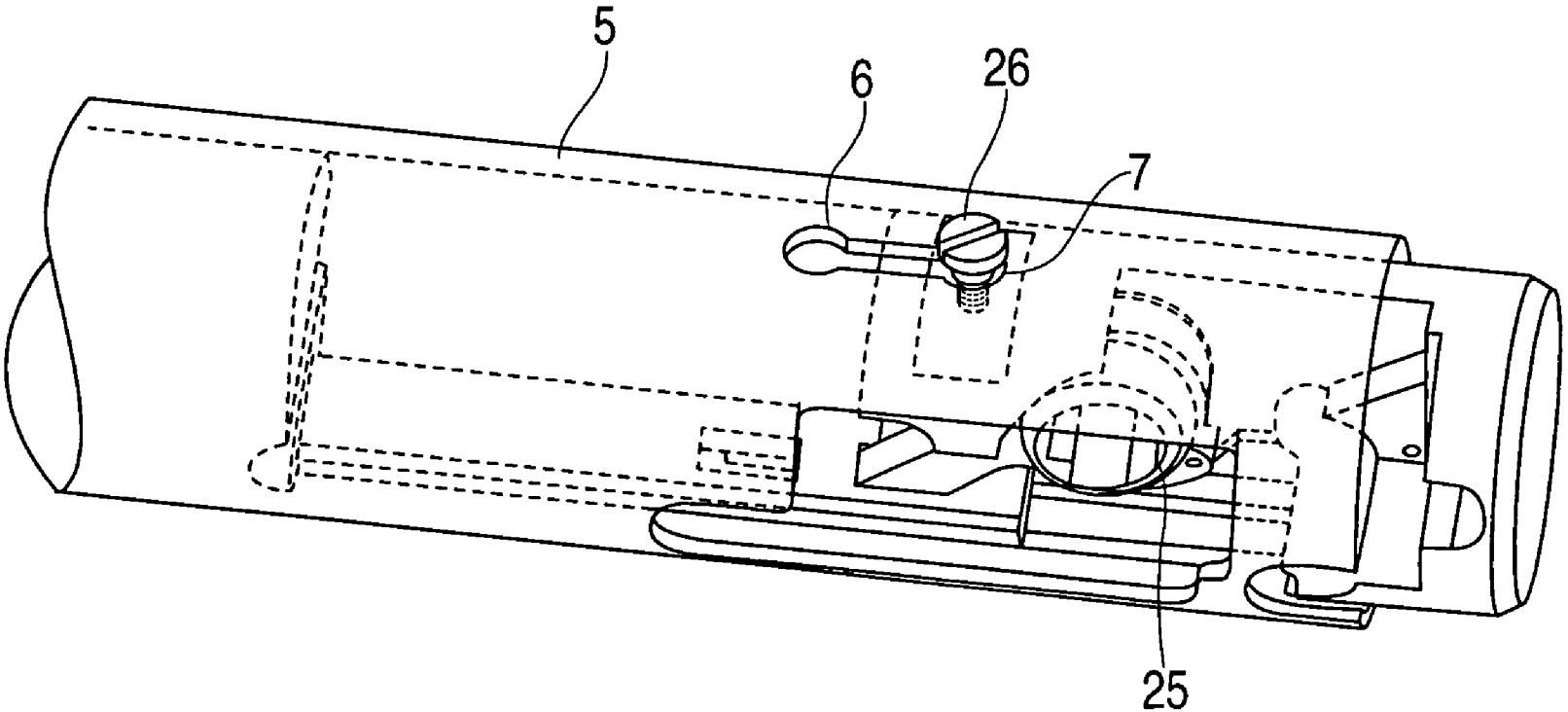
FIG. 9 is a top perspective view of the invention.

As best seen in FIGS. 3 and 4, the lock cylinder connector includes a hub 25 which is engaged by the lock cylinder for turning the deadbolt 17. As shown in FIG. 3 the link bar 13 is securely fastened to the deadbolt 17 through screw holes 11 and 12 and screw 14. Link bar 13 includes a plurality of attachment points, preferably two (2) slots 15 and 16 in the link bar which are used to change the backset of the deadbolt. When the deadbolt components are assembled, the distance between the outer surface of the face plate and the center of the hub defines a distance called the backset. Desirably, the backset can be set at 60 mm or 70 mm. A steel reinforcing rod 9 is desirably placed in the deadbolt 17 in hole 10 in rod 9 to add strength. Desirably rod 9 has a pointed end for marking a centering location on a door post. Rod 9 desirably protrudes slightly from the deadbolt so that the center of the deadbolt structure can be marked on a door post during installation. The protrusion of rod 9 allows marking a centering a hole in the door post for receipt of the deadbolt and simplifies installation.

An actuator 32 is operably connected to hub 25 for movement upon rotation of the hub 25 upon the action of the lock cylinder to which it is interconnected. The actuator 32 has an actuator arm 34. Actuator arm 34 desirably has a boot or projection 35 at the end remote from the hub 25 which fits into attachment slots 15 and 16 in link bar 13. When the hub is rotated by the action of the lock cylinder, the actuator 32 moves the link bar and the connected deadbolt 17 between the open and closed positions.

Desirably, the actuator arm 34 has an upward protrusion 33 on the end of the actuator arm adjacent to the hub 25. A boot or projection 35 is provided at the opposite end of the actuator arm 34 from the hub. A threaded screw hole 27 is provided in lock cylinder connector 38 for receipt of a releasable connector desirably screw 26. Screw positioning openings 6 and 7 which are interconnected by slot 36 are provided in hollow housing 5 for setting the backset at 60 mm or 70 mm as desired in conjunction with the slots 15 and 16. The releasable connector screw 26 extends through the housing 5 through openings 6 or 7 and engages threaded screw hole 27 in lock cylinder connector 38 and then extends through 27 to engage the actuator arm 34 desirably at protrusion 33 to lock the actuator in the link bar so that one of the two (2) selected backset positions are locked in place.

In operation, the backset can be changed without removing the deadbolt assembly from the hollow housing 5. Releasable connector is released by unscrewing screw 26 to disengage actuator arm 34 at protrusion 33. Then the hub 25 is rotated to move the actuator arm 34 to the alternate selected attachment point in the link bar. The link bar 13 is then moved along with the attached deadbolt to the new position. The actuator end boot 35 is then positioned into the selected slot either 15 or 16 and the releasable connector 26 is then reengaged to contact actuator arm 34, preferably at protrusion 33 and a new backset position is set. The screw 26 below the screw head slides in slot 36 between holes 6 and 7. Thus, the link bar 13 and deadbolt 17 can be moved and the backset changed without removal of the deadbolt assembly from housing 5. As a result the backset is adjusted quickly and simply without removing the deadbolt, the lock cylinder connector, the hub, the actuator or the link bar from the housing.

The foregoing is considered as illustrative only to the principals of the invention. Further, since numerous changes and modification will occur to those skilled in the art, it is not desired to limit the invention to the exact construction and operation shown and described above, and accordingly, all suitable modifications and equivalents may be resorted to, falling within the scope of the invention.

The invention claimed is:

1. A backset adjustable deadbolt for mounting with a lock cylinder comprising:

a) a deadbolt;

b) a lock cylinder connector for mounting with a lock cylinder;

c) said lock cylinder connector including a hub connectable to said lock cylinder;

d) an actuator directly connected to said hub and movable by the movement of said hub, said actuator having a proximate end adjacent to said hub and a remote end;

e) a link bar connecting said actuator to said deadbolt at a plurality of attachment points formed on said link bar; said link bar attachment points formed by a plurality of spaced slots in said link bar sized to receive the actuator remote end;

f) a housing receiving said deadbolt, said lock cylinder connector, said hub, said actuator and said link bar; said deadbolt slidingly disposed in said housing;

g) a face plate attached to said housing defining a distance, called a backset, between an outer surface of said face plate and a center of said hub;

h) a releasable connector extending through said housing having an engaged position and a disengaged position; said releasable connector in said engaged position directly contacting said actuator to lock said actuator remote end in one of said plurality of attachment points in said link bar; and said releasable connector in said disengaged position releasing said actuator remote end from said link bar to allow said link bar to be moved relative to said actuator from one of said plurality of attachment points to a different one of said plurality of attachment points for engagement with said actuator remote end, thereby adjusting said backset.

2. An adjustable deadbolt according to claim 1 wherein:

said backset is adjustable between a first backset and a second backset without removing said deadbolt assembly from said housing when said releasable connector is in said engaged position by moving said deadbolt assembly relative to said housing.

3. An adjustable deadbolt according to claim 1 wherein:

j) said actuator having a protrusion on the proximate end of said actuator;

k) said releasable connector directly contacting said protrusion in said engaged position to lock said actuator remote end in one of said plurality of slots when said connector is in the engaged position.

4. An adjustable deadbolt according to claim 1 wherein said link bar has a first and a second slot located along said link bar so that when said actuator remote end is received by said first slot the backset is 60 mm and when said actuator remote end is received by said second slot the backset is 70 mm.

5. An adjustable deadbolt according to claim 1 wherein said deadbolt includes a reinforcing bar.

6. An adjustable deadbolt according to claim 1 wherein said deadbolt includes a projection extending from an end of said deadbolt to provide a locator mark on a doorpost during installation so that a latch keeper can be positioned in said doorpost.

7. An adjustable deadbolt according to claim 5 wherein said reinforcing bar extends past the end of said deadbolt to provide a projection extending from an end of said deadbolt to provide a mark on a doorpost during installation so that a latch keeper can be installed in said doorpost for receipt of said deadbolt.

8. An adjustable deadbolt according to claim 1 further comprising:

said releasable connector is a screw.

9. An adjustable deadbolt according to claim 8 further comprising:

a screw receiving aperture located in said lock cylinder connector; said screw extending through said lock cylinder connector to contact said actuator remote end in said engaged position.

10. An adjustable deadbolt according to claim 8 further comprising: a first and a second aperture located in said housing for receipt of said screw; said first aperture for receipt of said screw for a first backset and said second aperture for receipt of said screw for a second backset; a channel connecting said apertures to allow the screw to be moved from aperture to aperture in said disengaged position without removing said screw from said housing.

11. An adjustable deadbolt according to claim 1 wherein said housing is cylindrical.

12. A method of adjusting a deadbolt for mounting with a lock cylinder comprising:

providing a deadbolt assembly comprising:

a) a deadbolt;

b) a lock cylinder connector mounted to a lock cylinder, said lock cylinder connector including a hub connectable to said lock cylinder;

c) an actuator connected to and movable by the movement of said lock cylinder, said actuator having a proximate end and a remote end;

e) a link bar that connects said actuator to said deadbolt at a plurality of attachment points formed on said link bar, said link bar attachment points formed by a plurality of spaced slots in said link bar sized to receive the actuator remote end;

f) mounting said deadbolt assembly in a housing; said deadbolt slidingly disposed in said housing;

g) a face plate attached to said housing defining a distance, called a backset, between an outer surface of said face plate and a center of said hub;

h) a releasable connector extending through said housing having an engaged position and a disengaged position; said releasable connector in said engaged position directly contacting said actuator to lock said actuator remote end in one of said plurality of attachment points in said link bar; and said releasable connector in said disengaged position releasing said actuator remote end from said link bar to allow said link bar to be moved from one of said plurality of attachment points to a different one of said plurality of attachment points for engagement with said actuator remote end, thereby adjusting said backset;

i) disengaging said releasable connector from contacting said actuator;

j) moving said link bar, said actuator remote end or both so that said actuator remote end engages a different attachment point to adjust the backset.

13. A method of adjusting a deadbolt for mounting with a lock cylinder according to claim 12 further comprising adjusting said backset without removing said deadbolt assembly from said housing.

14. A method of adjusting a deadbolt for mounting with a lock cylinder according to claim 12 further comprising adjusting said backset is between a first backset and a second backset without removing said deadbolt assembly from said housing when said releasable connector is in said engaged position by moving said deadbolt assembly relative to said housing.

* * * * *